US006543417B2

(12) United States Patent
Tanaka et al.

(10) Patent No.: US 6,543,417 B2
(45) Date of Patent: Apr. 8, 2003

(54) INTAKE AIR CONTROL DEVICE

(75) Inventors: Kunio Tanaka, Nagoya (JP); Takashi Hamaoka, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/167,508

(22) Filed: Jun. 13, 2002

(65) Prior Publication Data

US 2002/0189584 A1 Dec. 19, 2002

(30) Foreign Application Priority Data

Jun. 14, 2001 (JP) ..... 2001-180388

(51) Int. Cl.[7] ..... F02D 9/10
(52) U.S. Cl. ..... 123/399; 123/361
(58) Field of Search ..... 123/399, 361

(56) References Cited

U.S. PATENT DOCUMENTS 4,392,375 A * 7/1983 Eguchi et al. ..... 73/118.1
5,738,072 A 4/1998 Bolte et al.
6,116,215 A * 9/2000 Soleanicov et al. ..... 123/399
6,446,600 B1 * 9/2002 Scherer et al. ..... 123/399
2001/0045203 A1 * 11/2001 Arsic et al. ..... 123/399

FOREIGN PATENT DOCUMENTS

JP 8-254129 10/1996
JP 11-343878 12/1999
JP 2001-3769 1/2001

* cited by examiner

*Primary Examiner*—Erick Solis
(74) *Attorney, Agent, or Firm*—Nixon & Vanderhye P.C.

(57) ABSTRACT

In an intake air control device, a valve gear for driving a shaft of a throttle valve is made of non-magnetic metal that does not interfere with a magnetic circuit constituted by split type permanent magnet and yoke. Accordingly, as the magnetic flux from the magnetic circuit is effectively used without leakage to the valve gear, an opening degree of the throttle valve is accurately detected by a non-contact type Hall element. Further, it is not necessary to reinforce with other metal a ring shaped fixing portion of the valve gear that is rigidly fixed to an end of the shaft by staking or welding and an outer protrusion of the valve gear that comes in hitting contact with a stopper of a throttle body when the throttle valve is fully closed, resulting in less number of component parts and lower cost.

8 Claims, 2 Drawing Sheets

INTAKE AIR CONTROL DEVICE

CROSS REFERENCE TO RELATED APPLICATION

This application is based upon and claims the benefit of priority of Japanese Patent Application No. 2001-180388 filed on Jun. 14, 2001, the content of which is incorporated herein by reference.

BACKGROUND OF THE INVENTION

1. Field of the Invention

The present invention relates to an intake air control device, in particular, having an angular position detector capable of detecting an opening degree of a throttle valve for an internal combustion engine.

2. Description of Related Art

JP-A-8-254129 describes an intake air control device for an internal combustion engine as a prior art. This intake air control device has a throttle body provided with an intake air conduit leading to the internal combustion engine, a throttle valve mounted on a shaft rotatably held in the throttle body for opening and closing the intake air conduit, a valve gear fixed by means of a nut to an end of the shaft of the throttle valve, an intermediate speed reduction gear in mesh with the valve gear and a motor driving the intermediate speed reduction gear.

According to this conventional control device, a throttle position sensor is located at another end of the shaft on a side opposite to the valve gear. This construction makes an entire body of the control device larger. It is preferable that the throttle position sensor is a non-contact type sensor, in which a change of magnetic flux generated from a magnetic circuit constituted by a magnet and a yoke is detected by a non-contact type detecting element, and located at the end of the shaft on the same side as the valve gear. Further, in the conventional control device, the valve gear, which is formed in half-moon shape, has a notch portion coming in hitting contact with a stopper fixed to an installation base of the throttle body when the throttle valve is at a fully closed position.

However, the conventional control device has a drawback that, if the non-contact type sensor is employed, the valve gear interferes with the magnetic circuit so that magnetic flux generated from the magnetic circuit leaks to the valve gear since the valve gear is made of iron base magnetic metal.

Accordingly, the opening degree of the throttle valve or the angular position of the shaft can not be accurately detected. On the other hand, if the valve gear is made of thermoplastic resin, it is required to reinforce with metal material each local portion of the valve gear that is rigidly fixed to the shaft for installation or comes in hitting contact with the stopper. As a result, insert molding of many component parts including the magnet and the yoke becomes necessary when the valve gear is formed, causing higher manufacturing cost.

SUMMARY OF THE INVENTION

An object of the invention is to provide an intake air control device for an internal combustion engine in which a change of magnetic flux generated in a magnetic circuit in response to a change of an opening degree of a throttle valve is accurately detected with less number of component parts and at lower manufacturing cost.

To achieve the above object, in the intake air control device having a throttle body having an intake conduit to the internal combustion engine, a throttle valve having a shaft rotatably held in the throttle body for opening and closing the intake conduit, a rotary member rigidly fixed to the shaft for driving the shaft in response to an acceleration pedal so as to rotate the throttle valve and a non-contact type angular position detector having a magnetic flux generating member and a magnetic flux detecting element, the rotary member is made of non-magnetic metal, the magnetic flux generating member is attached to the rotary member so as to rotate together therewith and the magnetic flux detecting element is stationarily positioned to face the magnetic flux generating member with an air gap therebetween.

With the device mentioned above, the magnetic flux detecting element generates an electric signal in response to a change of magnetic flux applied thereto from the magnetic flux generating member so that an angular position of the shaft driven by the rotary member is detected. Since the rotary member is made of non-magnetic metal, the magnetic flux from the magnetic flux generating member is effectively applied to the magnetic flux detecting element without leaking to the rotary member so that the opening degree of the throttle valve is accurately detected.

Further, as the rotary member is made of non-magnetic metal, it is not necessary to reinforce with reinforcing material (such as other metal) a local portion of the rotary member that is rigidly fixed to the shaft.

It is preferable that the magnetic flux generating member is a permanent magnet and a yoke magnetized by the permanent magnet, both of which are rotatable together with the shaft and the rotary member.

Further, it is preferable that the rotary member has an outer protrusion integrally provided therewith and the throttle body has a stopper with which the outer protrusion comes in hitting contact for restricting further rotation of the rotary member when the throttle is fully closed. Since the rotary member is made of non-magnetic metal, it is not necessary to reinforce the outer protrusion that comes in hitting contact with the stopper. Accordingly, the control device can be manufactured with less number of component parts at lower cost.

Furthermore, it is preferable that the rotary member is formed in shape of a cup whose bottom wall is fixed to an end face of the shaft by staking or welding and whose inner circumferential wall is provided with the magnetic flux generating member. As the magnetic flux detecting element is accommodated inside the cap, an entire body of the non-contact type angular position detector becomes more compact.

BRIEF DESCRIPTION OF THE DRAWING

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Figure 1:
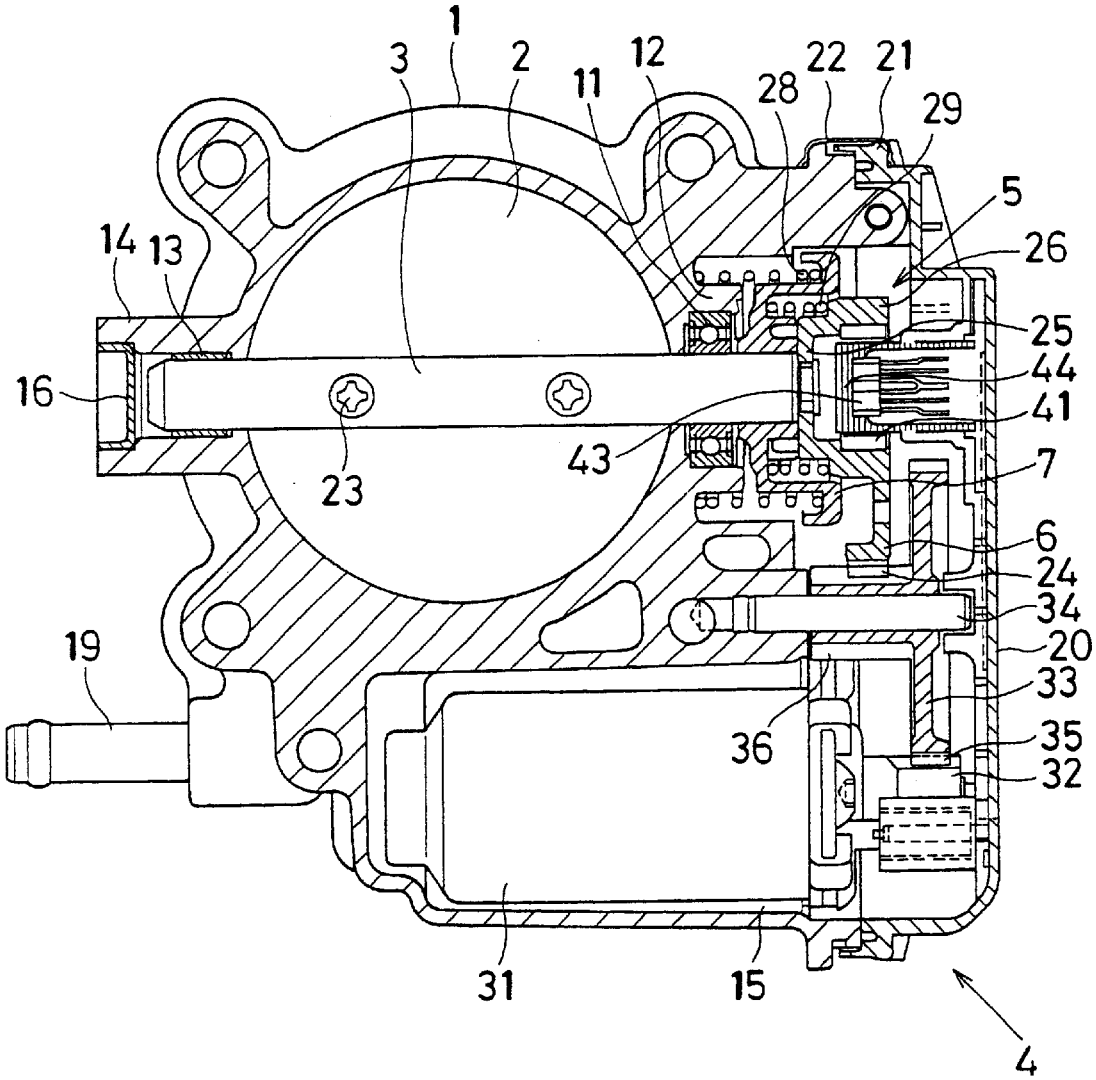
FIG. 1 is a cross sectional view of an intake air control device for an internal combustion engine according to a preferred embodiment of the present invention.
Figure 2:
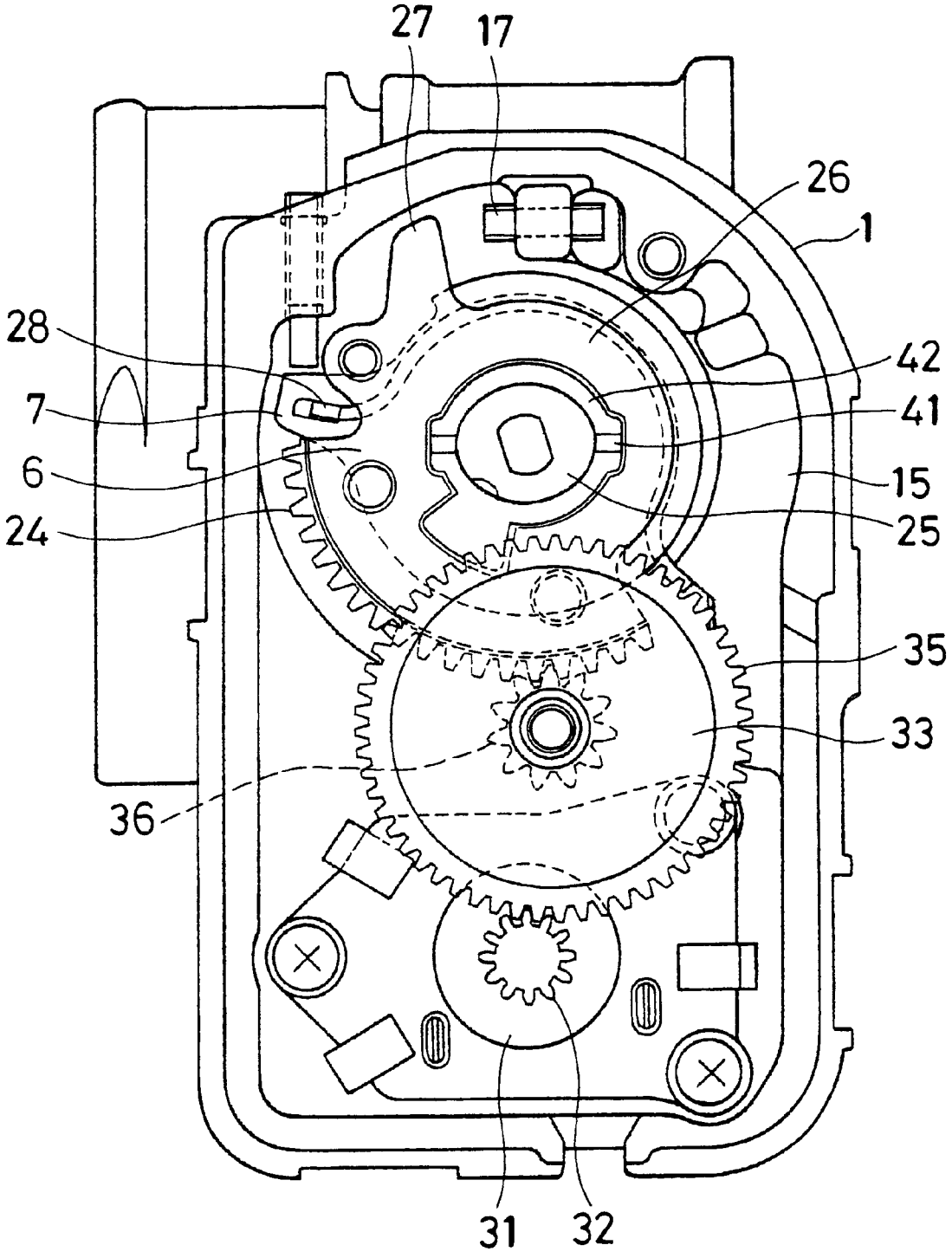
FIG. 2 is an elevation view of the intake air control device of FIG. 1 without a sensor cover.

An intake air control device for an internal combustion engine according to a preferred embodiment is described with reference to FIGS. 1 and 2.

The intake air control device is composed of a throttle body 1 in which an intake air conduit leading to the internal combustion engine (engine) is formed, a throttle valve 2 having a shaft 3 rotatably held in the throttle body 1, an actuator 4 driving the shaft 3 to rotate, and an engine control unit (ECU) electrically controlling the actuator 4. The intake air control device is operative to regulate an amount of intake air to be introduced into the engine according to a depressing operation of an acceleration pedal of a vehicle so that revolution speed of the engine is controlled. An acceleration pedal position sensor (not shown) that generates an electric signal representing an acceleration pedal depressing degree is connected in circuit with ECU.

The intake air control device is further provided with a throttle valve position sensor 5 that generates an electric signal representing an opening degree of the throttle valve 2 and outputs it to ECU. The throttle body 1, made of aluminum by die-casting, is fixed by fastening means such as bolts to an intake manifold of the engine for holding the throttle valve 2. The throttle body 1 has a bearing holding portion 12 where an end of the shaft 3 is rotatably held via a ball bearing 11, another bearing holding portion 14 where the other end of the shaft 3 is rotatably held via a dry bearing 13 and an accommodation portion 15 where the actuator 4 is housed. An opening end of the bearing holding portion 14 is closed with a plug 16.

A stopper 17, with which a valve gear 6 comes in hitting contact on fully closing the throttle valve 2, is fixed to the throttle body 1 by screwing. The stopper 17 serves to restrict further movements of the throttle valve 2 and the shaft 3 when the throttle valve 2 is fully closed. A warm water pipe 19, through which warm water (engine coolant) is introduced to the throttle body 1 for preventing icing of moisture on and around the throttle valve 2, is attached to the throttle body 1. A sensor cover 20, which is made of thermoplastic resin for electrically insulating associated terminals of the throttle position sensor 5, is mounted on the throttle body 1 for closing an opening thereof. A fitting portion 21 of the sensor cover 20 is coupled with and fixed by a cylindrical clip 22 to a fitting portion of the throttle body 1 provided on an opening side thereof.

The throttle valve 2 is a butterfly like rotary valve for controlling an amount of intake air to be introduced to the engine and is fixed to an outer circumference of the shaft 3 by fastening means 23 such as fastening screws. The throttle valve 2 of the present embodiment is made of a metal or resin plate and formed in a disk shape. The valve gear 6 (rotary member) is fixed to the end of the shaft 3. The valve gear 6 is made of non-magnetic material such as stainless steel sintered metal, for which rustproof treatment is not necessary, and formed roughly in a cup shape. The valve gear 6 has a radially outward protruding fun shaped portion whose outer periphery is provided with a gear portion 24 in mesh with an intermediate speed reduction gear 33. The valve gear 6 is further provided at a bottom thereof with a ring shaped fixing portion 25 that is fixed to the end of the shaft 3 by staking or welding, at inner circumference thereof with a cylindrical holding portion 26 that holds a split type permanent magnet 41 and a split type yoke 42, and at outer circumference thereof with an outer protrusion 27 that comes in hitting contact with the stopper 17 fixed to the throttle body 1 when the throttle valve 2 is fully closed.

A resin rotor member 7 is disposed rotatably around an outer circumference of the shaft 3 between the valve gear 6 and an inner race of the ball bearing 11. Coil shaped return springs 28 and 29 are arranged between a left end of the valve gear 6 and a right end of the rotor member 7 and between a left end of the rotor member and a right end of the throttle body 1, respectively, as shown in FIG. 1 and serve to return the throttle valve 2 and the shaft 3 to initial positions so that the engine is at idling revolution speed.

The actuator 4 is composed of a motor 31 that is electronically controlled by ECU, a pinion gear (motor gear) 32 fixed to an outer circumference of an output shaft of the motor 31 and rotatable together with the output shaft thereof, the intermediate speed reduction gear 33 rotatable in mesh with the pinion gear 32 and the valve gear 6 rotatable in mesh with the intermediate speed reduction gear 33. The actuator 4 is a valve drive member for driving the throttle valve 2 and the shaft 3 to rotate. The motor 31, which is a driving source, is connected in circuit with terminals integrally embedded in the sensor cover 20 and, when energized through the terminals, drives the pinion gear 32.

The intermediate speed reduction gear 33, which is formed by resin molding, is rotatably fitted to an outer circumference of a holding shaft 34 located at a rotation axis thereof. The intermediate speed reduction gear 33 is composed of a large diameter gear 35 in mesh with the pinion gear 32 and a small diameter gear 36 in mesh with the gear portion 24 of the valve gear 6. The pinion gear 32 and the intermediate speed reduction gear 33 constitute a torque transmission member for transmitting torque of the motor 31 to the valve gear 6. An end of the holding shaft 34 is fitted to a hole provided in an inner wall of the sensor cover 20 and the other end of the holding shaft 34 is press fitted to a hole provided in an outer wall of the throttle body 1.

The throttle position sensor 5, which is an angular position detector, is composed of the split type (near square shaped) permanent magnet 41 for generating magnetic flux, the split type (near arc shaped) yoke (magnetic material) 42 that is magnetized by the permanent magnet 41, Hall element 43 integrally arranged on a side of the sensor cover 20 so as to be opposed to the permanent magnet 41, terminals (not shown), which is made of conductive thin metal plate, for connecting the Hall element 43 in circuit with ECU located outside, and a stator 44 made of iron base metal (magnetic material) for concentrating magnetic flux to the Hall element 43.

The split type permanent magnet 41 and the split type yoke 42 are fixed by means of glue to an inner circumference of the holding portion 26 of the valve gear 6. Each piece of the split type permanent magnet 41 is disposed between adjacent two pieces of the split type yoke 42. Each pole of two square shaped pieces of the split type permanent magnet 41 is orientated in the same direction (upper side is N pole and lower side is S pole in FIG. 2). The Hall element 43 is a non-contact type detecting element and positioned so as to be opposed to inner circumferences of the two pieces of the split type permanent magnet 41. When N pole or S pole magnetic field is applied to a sensing surface of the Hall element 43, the Hall element 43 generates an electromotive force in response to the magnetic field (+ electrical potential when N pole magnetic field is applied and – electrical potential when S pole magnetic field is applied).

An operation of the intake air control device is described with reference to FIGS. 1 and 2.

When a driver depresses the acceleration pedal, the electric signal representing the acceleration pedal depressing degree is input to ECU from the acceleration pedal position sensor. Then, ECU energizes the motor 31 so as to rotate the output shaft thereof to an extent that the throttle valve 2 is opened by a corresponding amount. The rotation of the output shaft of the motor 31 causes the pinion gear 32 to rotate counterclockwise in FIG. 2 so that the torque of the motor 31 is transferred to the large diameter gear 35 of the intermediate speed reduction gear 33. As the large diameter gear 35 rotates, the small diameter gear 36 rotates clockwise centered on the holding shaft 34 in FIG. 2 so that the valve gear 6 having the gear portion 24 in mesh with the small diameter portion 36 rotates. Accordingly, since the valve gear 6 rotates counterclockwise centered on the shaft 3 in FIG. 2, the shaft 3 rotates to make the corresponding angular position so that the throttle valve 2 is kept at a given position in the intake air conduit provided in the throttle body 1.

The throttle position sensor 5 detects the angular position of the permanent magnet 41 rotating together with the valve gear 6 by means of the Hall element 43 and delivers via the terminals to ECU an electric signal representing a throttle valve opening degree. ECU decides an amount of fuel to be supplied to the engine according to the electric signal from the throttle position sensor 5. When the driver returns the acceleration pedal to the initial position, the throttle valve 2, the shaft 3 and the valve gear 6 are returned to the original angular position by biasing forces of the springs 28 and 29 and/or reverse rotation of the motor 31 so that the throttle valve 2 is fully closed and the revolution speed of the engine becomes idling revolution speed.

According to the intake air control device mentioned above, material of the valve gear 6 is non-magnetic metal that does not interfere with the magnetic circuit constituted by the split type permanent magnet 41 and the split type yoke 42, that is, does not adversely affect on detecting accuracy of the Hall element 43. Accordingly, the magnetic flux from the magnetic circuit is effectively used without leakage to the valve gear 6 so that the opening degree of the throttle valve 2 is accurately detected by means of the non-contact type Hall element 43. Further, since the valve gear 6 is made of non-magnetic metal, it is not necessary to reinforce with reinforcing material (such as other metal) the ring shaped fixing portion 25 that is rigidly fixed to the end of the shaft 3 by staking or welding and the outer protrusion 27 that comes in hitting contact with the stopper 17 when the throttle valve 2 is fully closed, resulting in less number of component parts and lower manufacturing cost.

Moreover, since the material of the valve gear 6 is stainless steel sintered metal, it is not necessary to carry out the rustproof treatment for preventing a surface of the valve gear 6 from rusting, that is, to treat the surface of the valve gear 6 with soluble zinc plating or electric zinc plating. Accordingly, the valve gear 6 can be more simply manufactured at less cost. Furthermore, as the valve gear 6 is fixed to the end of the shaft by staking or welding, axial length of the shaft is shorter, compared with a case that the valve gear 6 is fastened and fixed to the shaft by fastening means such as a nut, so that the magnetic circuit constituted by the permanent magnet 41 and the yoke 42 is more compact, resulting in making an entire body of the intake air control device more compact.

Instead of rotating the valve gear 6 (rotor member) through the motor 31, the pinion gear 32 and the intermediate speed reduction gear 33, the rotor member 6 may be rotated directly by a wire cable and/or an acceleration lever mechanically connected to the acceleration pedal and movable in response to the depressing amount of the acceleration pedal. In this case, the rotor member 6 may have the gear portion 24 in mesh with a gear provided with the acceleration lever or may not have the gear portion 24 but have any associated portion engaged with the wire cable and/or the acceleration lever. Further, the rotary member 6 may be the acceleration lever itself to which the wire cable is connected so as to move together with the acceleration pedal.

Moreover, instead of the Hall element 43, hall IC or a magnetic resistance element may be employed as the non-contact type detecting element. Furthermore, instead of the split type permanent magnet 41, a cylindrical permanent magnet may be employed as a magnetic flux generating source.

What is claimed is:

1. An intake air control device movable in response to an acceleration pedal for an internal combustion engine comprising:

a throttle body having an intake conduit to the internal combustion engine;

a throttle valve having a shaft rotatably held in the throttle body for opening and closing the intake conduit;

a rotary member made of non-magnetic metal and rigidly fixed to the shaft for driving the shaft in response to the acceleration pedal so as to rotate the throttle valve; and a non-contact type angular position detector having a magnetic flux generating member and a magnetic flux detecting element, the magnetic flux generating member being attached to the rotary member so as to rotate together therewith and the magnetic flux detecting element being stationarily positioned to face the magnetic flux generating member with an air gap therebetween, wherein the magnetic flux detecting element generates an electric signal in response to a change of magnetic flux applied thereto from the magnetic flux generating member so that an angular position of the shaft driven by the rotary member is detected.

2. An intake air control device according to claim 1, wherein the magnetic flux generating member is a permanent magnet and a yoke magnetized by the permanent magnet.

3. An intake air control device according to claim 1, wherein the non-magnetic material of the rotary member is material that is practically usable without carrying out rustproof treatment.

4. An intake air control device according to claim 1, wherein the rotary member has an outer protrusion integrally provided therewith and the throttle body has a stopper with which the outer protrusion comes in hitting contact for restricting further rotation of the rotary member when the throttle is fully closed.

5. An intake air control device according to claim 1, wherein the rotary member is formed in shape of a cup whose bottom wall is fixed to an end face of the shaft by one of processes of staking and welding and whose inner circumferential wall is provided with the magnetic flux generating member and, further, wherein the magnetic flux detecting element is accommodated inside the cap.

6. An intake air control device according to claim 1, further comprising;

a motor operative in response to the acceleration pedal and accommodated in the throttle body for generating torque; and a torque transmission member engaged with the motor, wherein the rotary member is engaged with the torque transmission member and is driven by the motor through the torque transmission member.

7. An intake air control device according to claim 6, further comprising;

a sensor cover attached to the throttle body for covering the non-contact type angular position detector, wherein the torque transmission member comprises a motor gear attached to an output shaft of the motor and an intermediate gears one of which is in mesh with the motor gear and another of which is in mesh with the rotary member and, further, wherein the sensor cover and the intermediate gears are made of non-magnetic material.

8. An intake air control device according to claim 1, wherein the rotary member is mechanically connected to the acceleration pedal.

* * * * *